United States Patent [19]

Nayate

[11] Patent Number: 4,496,141

[45] Date of Patent: Jan. 29, 1985

[54] METHOD AND APPARATUS FOR OPENING FOLDED NEWSPAPERS

[75] Inventor: Pramod D. Nayate, Wheaton, Ill.

[73] Assignee: Rockwell International Corporation, Pittsburgh, Pa.

[21] Appl. No.: 450,592

[22] Filed: Dec. 17, 1982

[51] Int. Cl.[3] ..... B65H 5/30

[52] U.S. Cl. ..... 270/55

[58] Field of Search ..... 270/55-60

[56] References Cited

U.S. PATENT DOCUMENTS

| | | | |
|---|---|---|---|
| 3,420,516 | 1/1969 | Guggisberg | 270/55 |
| 3,580,562 | 5/1971 | Reist | 270/54 |
| 3,711,083 | 1/1973 | Cantrell | 270/55 |
| 3,752,468 | 8/1973 | Hart et al. | 270/55 |
| 3,988,016 | 10/1976 | Merker et al. | 270/55 |
| 4,116,427 | 9/1978 | Muller | 270/55 |
| 4,241,908 | 12/1980 | Marcus | 270/55 |
| 4,373,710 | 2/1983 | Hansen | 270/55 |
| 4,416,448 | 11/1983 | Meier | 270/57 |

*Primary Examiner*—E. H. Eickholt

[57] ABSTRACT

A device for opening newspapers located within individual pockets of an endless conveyor for receiving inner sections. The folded edge of the newspapers are located at the bottom of the pockets formed by first and second panel members directed upwardly and away from one another defining pockets of a generally V-shaped configuration. A cam controlled plate member pivotably mounted on the first panel member is effective in moving the cut edges to a vertical position against the second panel member. A pair of opposed levers having vacuum controlled suction cups on their free ends are pivoted to engage the outer surface of the paper adjacent its fold and as they are pivoted outwardly form a center opening at the fold. An opener arm is then pivoted into the opening and upwardly and is effective in holding one-half of the paper against the second panel while the other half drops back into engagement with the first panel.

6 Claims, 10 Drawing Figures

FIG. 2
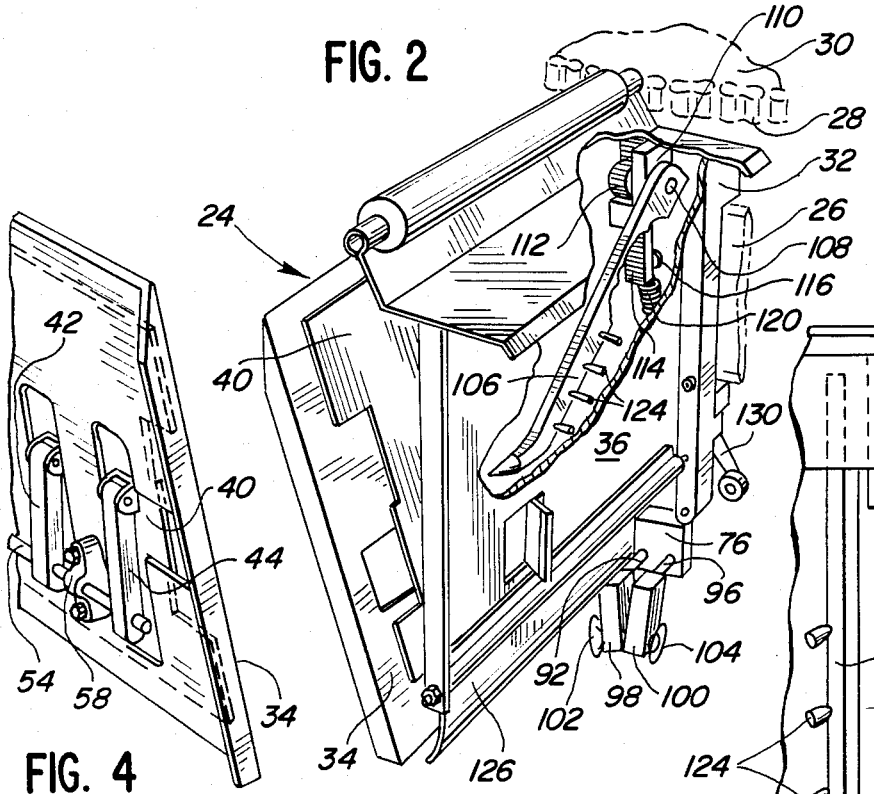
FIG. 4
FIG. 5
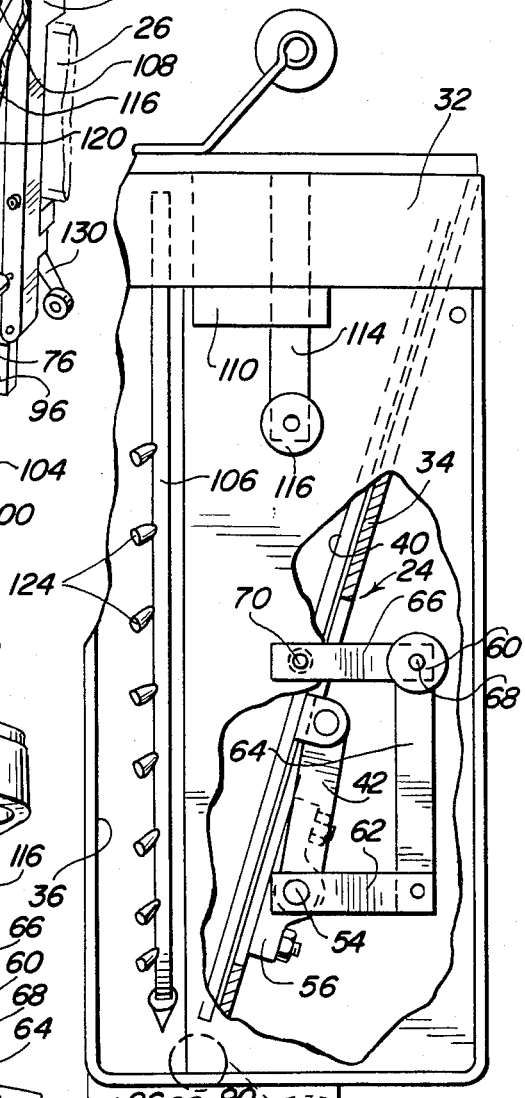
FIG. 3
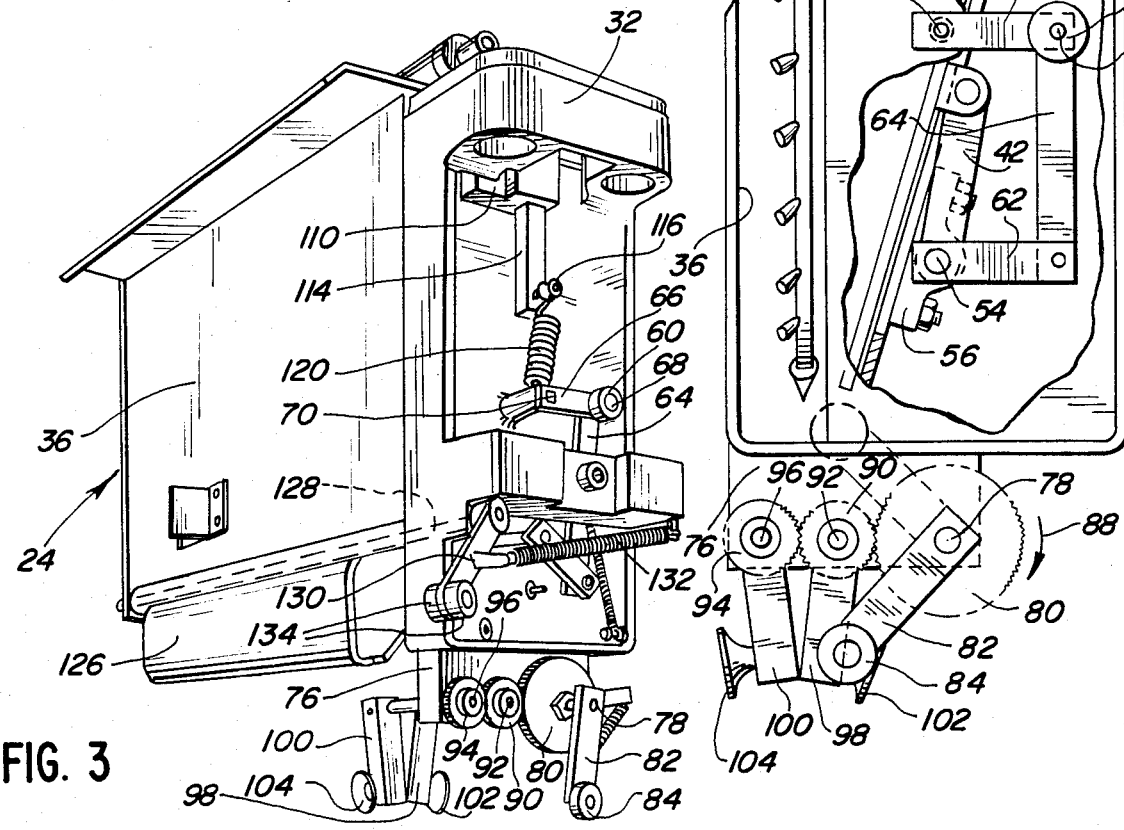

METHOD AND APPARATUS FOR OPENING FOLDED NEWSPAPERS

BACKGROUND OF THE INVENTION

1. Field of the Invention

The present invention pertains to a method and apparatus for opening newspapers for the purpose of inserting inner sections therein and, more particularly, to an improved apparatus for continuously opening a newspaper at its center section and which requires fewer elements to perform its intended function than known devices of the prior art.

2. Description of the Prior Art

A number of United States patents show and describe devices for opening newspapers for the purpose of inserting inner sections and, for reference to the teachings of such disclosures, attention is hereby directed to U.S. Pat. Nos. 3,580,562; 3,692,301; 4,116,427 and 4,241,908.

SUMMARY OF THE INVENTION

The apparatus for opening newspapers according to the invention is operatively associated with V-shaped pockets of an endless conveyor within which the papers are deposited with their folded edges at the bottom or narrower portion of the pockets. These pockets are formed by first and second panel members whereby the latter extends upwardly in a vertical plane and the first generally upward at an angle oblique to the second panel. A cam controlled plate member is pivotably attached to the first panel member against which the newspaper rests and, by means of a cam controlled follower and linkage operatively connecting the latter with the plate member, a means is provided for pushing the paper to a vertical position against the second panel member.

With the newspaper held against the second panel member, a pair of opposed levers having vacuum controlled suction cups on their free ends are pivoted into contact with the exterior surface of the paper adjacent its folded edge. The levers are then pivoted in the opposite direction which causes the suction cups to create a center opening at the folded area of the paper. While the suction cups are holding the paper partially open, a cam controlled opener arm is caused to pivot into the center opening and upwardly to a position whereat it is effective in holding one half of the jacket or newspaper in contact with the second panel member. Upon release of the vacuum controlled suction cups, the unheld half of the newspaper drops back into contact with the first panel member whereat the opened paper is in readiness for receiving inner sections from a stuffing apparatus.

It is a general object of the invention to provide an improved apparatus for opening newspapers that will consistently open them at their center section.

It is a further object to provide a newspaper opening member that serves to retain the paper as required and which necessitates a minimum number of elements for performing its intended function.

These and other objects of the invention will become more fully apparent by reference to the appended claims and as the following detailed description proceeds in reference to the figures of drawing wherein:

BRIEF DESCRIPTION OF THE DRAWINGS

FIG. 2 is a perspective view of one of the conveyor pockets with a portion broken away to show the mechanism for actuating the opener arm;

FIG. 3 is a perspective view of a conveyor pocket showing in detail the end which attaches to the conveyor rail;

FIG. 4 is a perspective view of the left side of FIG. 2 showing the linkage for pivoting the cam controlled plate member;

FIG. 5 is an end view of a conveyor pocket showing the required elements for opening a newspaper to receive inner sections;

DESCRIPTION OF THE PREFERRED EMBODIMENT

Figure 1:
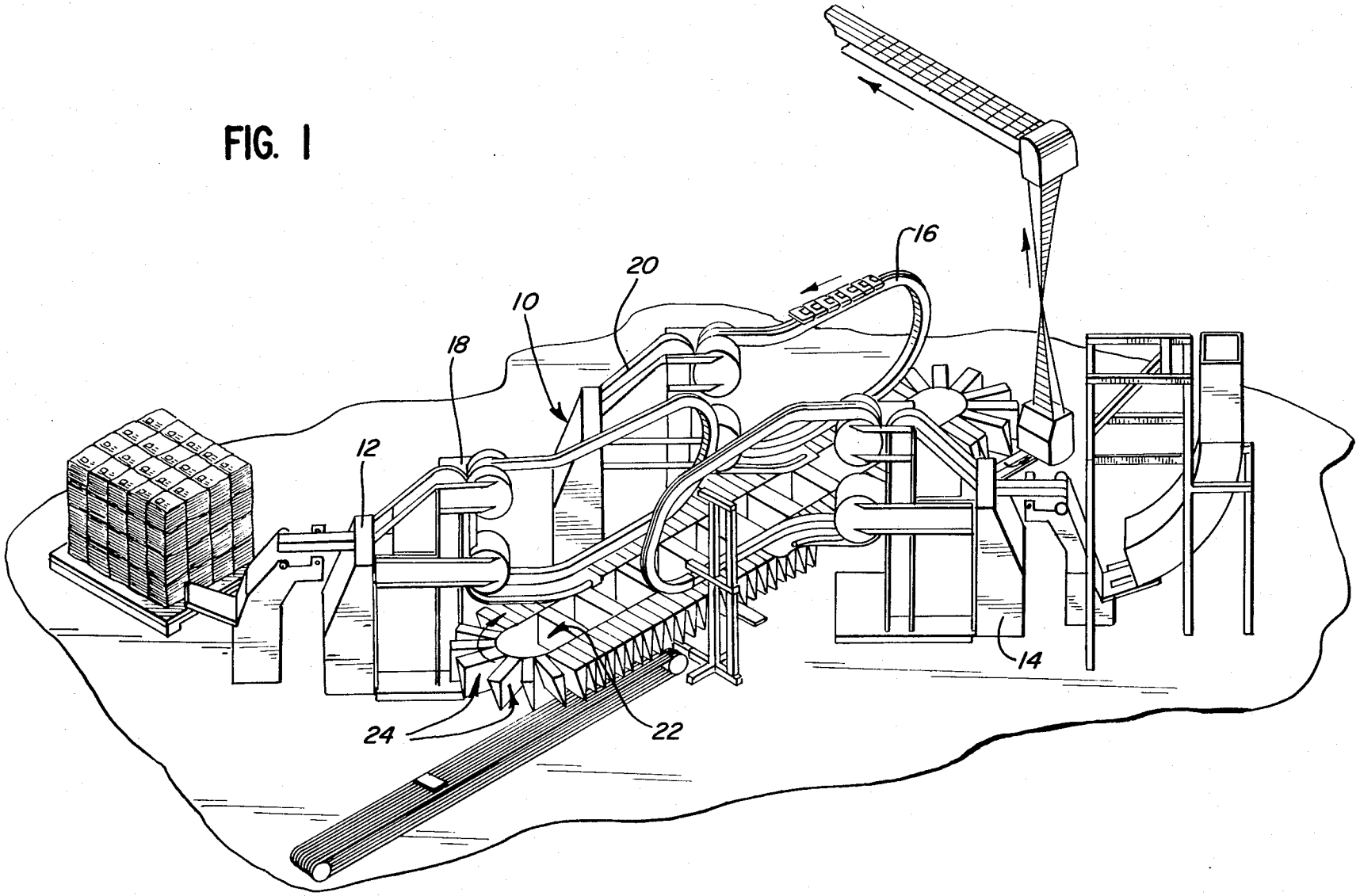
FIG. 1 is a perspective view of a newspaper assembler showing the endless conveyor and its pockets with which the apparatus according to the invention is operatively associated.

Referring now to FIG. 1, there is shown the various mechanisms that form a newspaper assembler that is identified generally by numeral 10. This assembler includes among its several mechanisms a pair of spaced stream markers 12 and 14, a gripper conveyor 16 and gripper loaders 18 and 20.

A pocket carousel or endless conveyor with which the present invention is operatively associated is identified generally by numeral 22 and is provided with a multiplicity of pockets of V-shaped configuration that are depicted generally by numeral 24.

As shown in FIG. 2, a portion of the endless conveyor rail is shown at 26 and the pockets 24 are caused to travel in their intended pathway by being operatively connected to an endless drive chain 28 that is disposed in operative engagement with a pair of spaced sprocket members 30 (one only shown).

As each of the pockets 24 are identical and contain the same elements for preparing a folded newspaper to receive inner sections, it is considered sufficient to show and describe in detail only one such pocket.

As shown in FIGS. 2 and 3, one end of the pocket 24 defines a support housing 32 which serves to attach it to the conveyor rail 26 and for housing various components of the invention yet to be described. Extending from the outer side of the support housing 32, the pocket is provided with first and second panel members identified by numerals 34 and 36 respectively. These panel members are disposed in spaced relation with the second one 36 extending upwardly in a vertical plane and the first one in a generally upward direction and at an angle oblique to the second panel. The combination of these panel members 34 and 36 form the V-shaped pockets into which a folded newspaper 38 is adapted to be deposited (FIGS. 7–10). A cam controlled plate member 40 is pivotably mounted on the upper ends of a pair of spaced fingers 42 and 44 (FIG. 6) as at 46 and 48 respectively. These fingers 42 and 44 extend through openings 50 and 52 in the first panel 34 and their lower ends are fixed on a shaft 54 that is mounted for rotative movement in bearing blocks 56 and 58 mounted on the outer surface of the panel 34. Shaft 54 extends beyond the first panel 34 into the support housing 32 whereat it is operatively connected to a cam follower 60 by means of linkage members 62 and 64. This cam follower 60 is rotatably mounted on one end of a support arm 66 as at 68. The arm 66 is pivotably mounted within the support housing as at 70. As the pockets are caused to travel about their pathway, the cam follower 60 is caused to engage and then be disengaged from a cam 72 mounted on the conveyor rail 26 (FIGS. 8 and 9). The cam 72 is effective in pivoting the cam follower 60 upwardly and, by means of the linkage members 62 and 64 as well as the fingers 42 and 44, the cam controlled plate member 40 is pivoted from that position shown in FIG. 7 to that position shown in FIG. 8. As shown in FIGS. 7 and 8, this movement is effective in moving the folded paper to a vertical position in contact with the second panel member 36. When the newspaper is in the position shown in FIG. 8, a mechanism now to be described is actuated to form a center opening 74 at the fold portion as shown in FIG. 9.

The lower end of the support housing 32 has a depending support block 76 attached thereto which has rod member 78 journaled therein for supporting a gear element 80 and one end of a lever 82 that carries a cam follower 84 at its free end. As the pockets are caused to travel about their pathway, the cam follower 84 is also caused to engage and then disengage a cam 86 (FIG. 9) which is effective in rotating the gear element 80 in the direction of the indicating arrow 88 in FIG. 9. Gear element 80 is in meshing relation with a gear pinion 90 mounted on one end of a support rod 92 that is journaled in the support block 76. Gear pinion 90 is also in meshing relation with an identical gear pinion 94 mounted on one end of a support rod 96 that is also journaled in the support block 76. Support rods 92 and 96 from their respective gear pinions 90 and 94 extend through and beyond the outer surface of the support block 76 and at their free ends have finger elements 98 and 100 respectively fixed thereon. The free ends of these finger elements 98 and 100 have suction cups 102 and 104 respectively mounted thereon and the cups are connected to any suitable source of vacuum not shown. Rotation of gear element 80 in the direction of the indicating arrow 88 causes gear pinions 90 and 94 to simultaneously rotate in the direction of the indicating arrows shown in FIG. 9. Rotation of these gear pinions 90 and 94 cause rotation of their respective support rods 92 and 96 in the same direction which is effective in rotating the finger elements 98 and 100 respectively in like directions so as to position their suction cups 102 and 104 in contact with the newspaper adjacent its folded portion. Cam 86 is then effective in reversing the movement of the finger elements 98 and 100 a sufficient distance so that the vacuum controlled suction cups are effective in pulling on the newspaper so as to form the center opening 74 at the fold. It should be noted that the vacuum cup apparatus described supra may not be necessary on the thicker jackets containing a plurality of sections.

Figure 6:
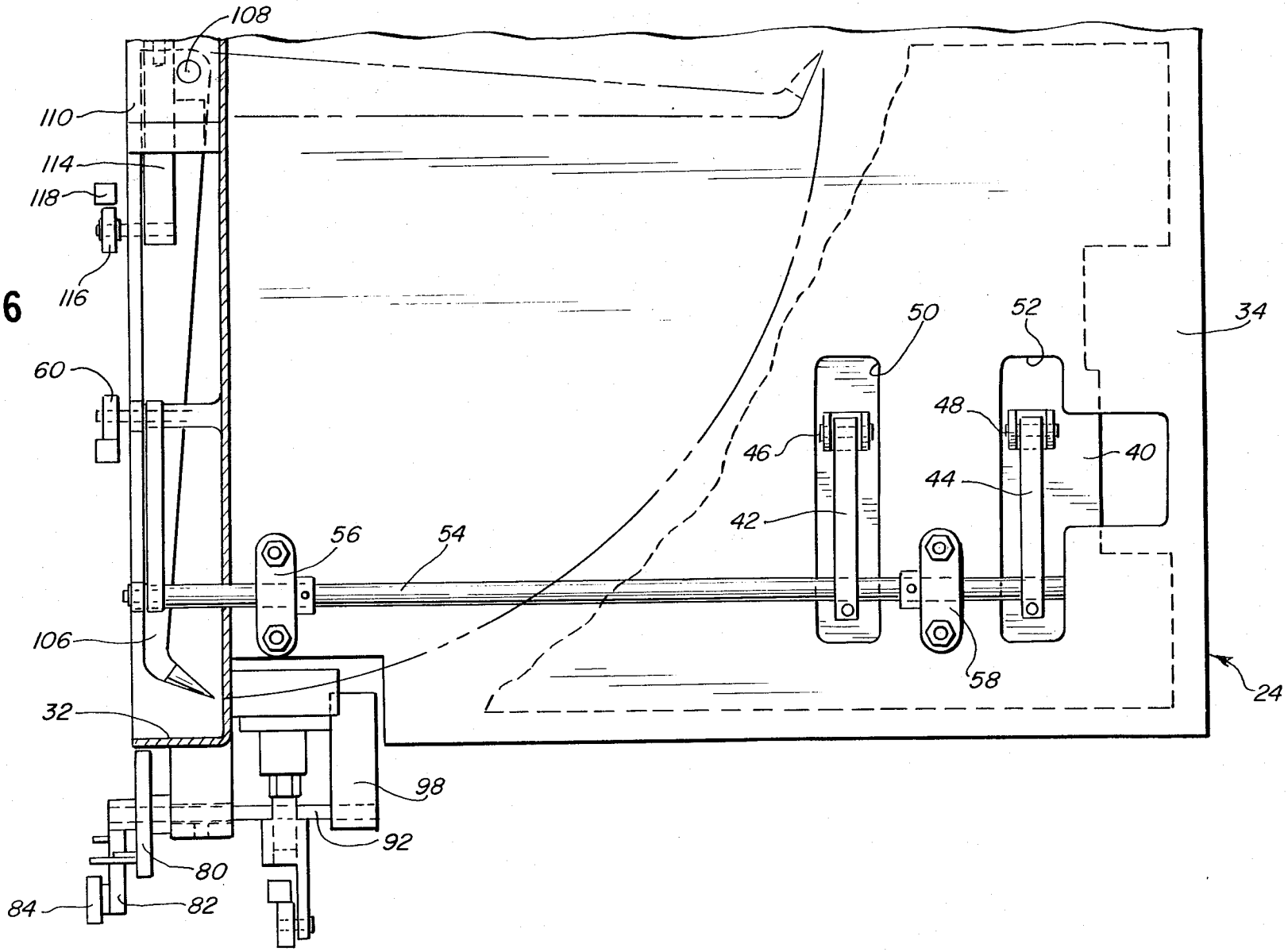
FIG. 6 is a view in side elevation of a conveyor pocket showing by means of full and phantom lines the inactive and active positions respectively of the opener arm.
Figures 7, 8, 9, 10:
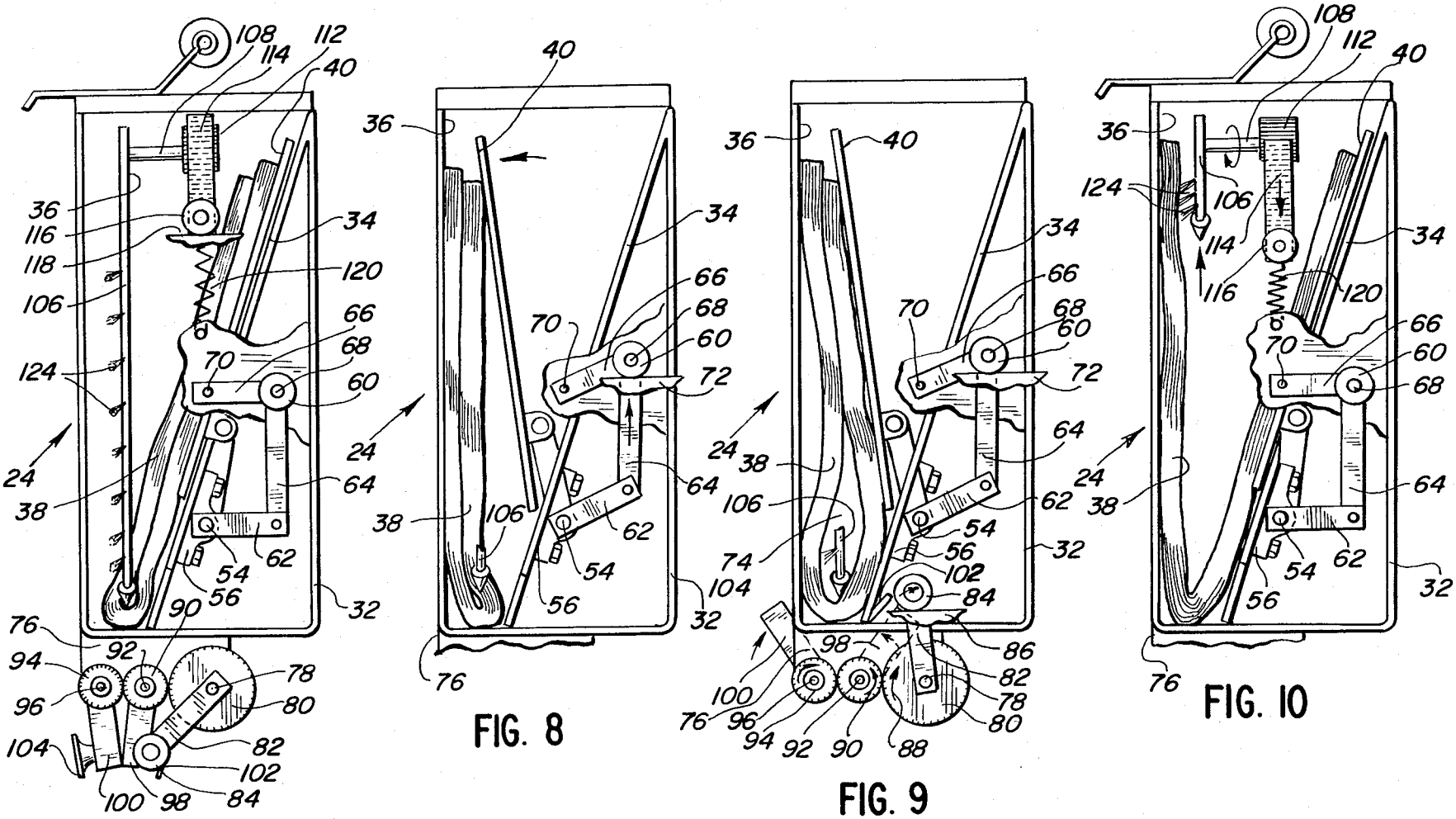
FIG. 7 is a view similar to FIG. 5 showing a folded newspaper in the conveyor pocket in close proximity with the first panel member.
FIG. 8 is a view similar to FIG. 7 showing the paper moved toward the second panel member by the cam controlled plate member.
FIG. 9 is a view similar to FIG. 8 showing the levers with the vacuum controlled suction cups in position for forming the center opening for receiving the opener arm.
FIG. 10 is a view similar to FIG. 9 showing the opener arm in position for holding half the paper in contact with the second panel member.

When the newspaper 38 is provided with the center opening 74 as shown in FIG. 9, a mechanism now to be described is caused to swing an opener arm 106 into the center opening and thence upwardly to a position shown in FIG. 10 and the phantom line position in FIG. 6.

As shown in FIGS. 2 and 6, one end of the opener arm 106 is fixed on a pin 108 for pivotable movement therewith which is journaled in and extends through a support block 110 mounted within the support housing 32. The end of the pin 108 protruding through the support block 110 has a gear pinion 112 fixed thereon that is disposed in meshing relation with a rack gear 114. This rack gear 114 is mounted for vertical sliding movement within the support block 110 and has a cam follower 116 rotatably mounted on the lower end thereof. During travel of the pockets about their pathway, the cam follower 116 is also caused to engage and disengage a cam 118 (FIG. 7) that is mounted on the conveyor rail 26. While the cam follower 116 is in contact with the cam 118 it is effective in maintaining the opener arm 106 in its inactive position which is that position depicted by solid lines in FIG. 6.

With reference to FIGS. 2, 3, 7 and 10, a coil spring 120 is shown having one end connected to the lower end of the rack gear 114 and the opposite end to a pin 122 located within the support housing 32 below the rack gear. When the cam follower 116 loses contact with cam 118, the coil spring 120 is effective in pulling the rack gear 114 downwardly so as to effect rotation of the gear pinion 112 which, in turn, rotates pin 108 and swings the opener arm 106 into the center opening 74 and thence upwardly to the phantom line position shown in FIG. 6 whereat it is effective in holding one half of the newspaper in contact with the second panel member 36. At this point, cam follower 60 loses contact with cam 72 which causes the cam controlled plate member 40 to return to its initial position of contact with the first panel member 34 and permits that half of the newspaper not being held by the opener arm 106 to drop back to the position shown in FIG. 10. With the two halves of the newspaper being in the position shown in FIG. 10, the paper is in readiness to receive the inner sections from a stuffing apparatus.

As shown in FIGS. 2 and 5, the opener arm 106 is provided with a plurality of tufts of bristles 124 which are disposed in spaced relation along the length of the opener arm and serve to facilitate the opening of the paper by causing the soft bristles to engage and hold the paper rather than the opener itself.

After the newspapers have received their inner sections, a means is provided for releasing them from the pockets for further processing. As shown in FIG. 3, a gate member 126 depends from a support rod 128 that is located adjacent the lower edge of the second panel 36 and extends into the support housing 32 where the inner end thereof has an arm 130 fixed thereon. This arm is biased in a downwardly direction by a coil spring 132 and is provided with a pair of cam followers 134 rotatably mounted on the free end thereof. These cam followers are adapted to engage a cam (not shown) that is also mounted on the conveyor rail 26 and is effective in swinging the gate member outwardly to release the newspaper from the pocket after the opener arm 106 has been returned to its solid line position shown in FIG. 6.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A method of opening folded newspapers for a stuffer that are individually deposited into separate conveyor receptacles of the type having first and second cooperating panel members defining a pocket with a generally V-shaped cross-sectional configuration, which includes the steps of:

(a) moving the opposed groups of cut edges of a folded newspaper from contact with a first panel member into contact with the second panel member;

(b) applying vacuum gripping members to the exterior of the folded newspaper;

(c) pivoting the gripping vacuum members away from each other to form a center opening;

(d) pivoting a separator arm into said center opening for engaging and holding one of the groups of cut edges in contact with the second panel;

(e) discontinuing activation of said gripping member while pivoting the separator arm, and returning the other group of cut edges into contact with the first panel member.

2. The method as claimed in claim 1, wherein the steps of pivoting a separator arm includes the step of camming a rack gear downwardly to effect rotation of a pinion operatively connected to one end of said separator arm.

3. A device for opening folded newspapers for a stuffer that are individually deposited into separator conveyor receptacles of the type having first and second cooperating panel members defining a pocket with a generally v-shaped cross-sectional configuration, said device comprising:

(a) means supported on the first panel member for moving opposed groups of cut edges of folded newspaper from the first panel into contact with the second panel which moving means includes:

(i) a plate member pivotally attached to the first panel member within the pocket, (ii) a cam controlled follower member operatively connected to said plate member for pivoting the latter toward and away from the second panel member as required, (iii) a horizontal shaft rotatably mounted on the first panel member in operative association with said cam controlled follower, (iv) a pair of upwardly extending arms having first ends fixed on said horizontal shaft and the opposed ends pivotally connected to said plate member;

(b) means operatively associated with the bottom of each pocket for separating the opposed groups of cut edges to define a center opening in the newspaper adjacent to its folded edge, wherein said separating means includes;

(i) a cam controlled follower member pivotably attached to the pocket;

(ii) a drive gear attached to one end of said follower member, (iii) a pair of opposed gear controlled lever members operatively connected to said drive gear, (iv) vacuum controlled suction grips fixed on the free ends of said lever members for movement (c) means pivotally mounted adjacent the side of panel members for entering said center opening to engage and hold one group of cut edges in contact with the second of said panel members while the other returns to engage said first panel member.

4. The structure according to claim 3, wherein said lever members each include a gear pinion attached to one end thereof with one in meshing relation with the other and said drive gear.

5. A device for opening folded newspapers for a stuffer that are individually deposited into separate conveyor receptacles of the type having first and second cooperating panel members defining a pocket with a generally V-shaped cross sectional configuration, said device comprising:

(a) means supported on the first panel member for moving opposed groups of cut edges of a folded newspaper therefrom into contact with the second panel member;

(b) means operatively associated with the bottom of each pocket for separating the opposed groups of cut edges to define a center opening in the newspaper adjacent its folded edge; and (c) an opener arm having drive means including:

(i) a support shaft for rotatably supporting said opener arm;

(ii) a rack and pinion gear combination operatively connected to said support shaft;

(iii) means defining a cam engaging follower mounted on said rack for preventing movement of the latter and rotation of said support shaft; and (iv) means for moving said rack and pinion to effect rotation of said support shaft and and actuation of said opener arm upon lack of cam engagement by said cam engaging follower.

6. The structure according to claim 5, wherein said moving means defines a spring member for moving said rack longitudinally.

* * * * *